US010242780B2

(12) United States Patent
Ohsawa et al.

(10) Patent No.: US 10,242,780 B2
(45) Date of Patent: Mar. 26, 2019

(54) RARE EARTH BASED PERMANENT MAGNET

(71) Applicant: TDK CORPORATION, Tokyo (JP)

(72) Inventors: Akihiro Ohsawa, Tokyo (JP); Yasushi Enokido, Tokyo (JP)

(73) Assignee: TDK CORPORATION, Tokyo (JP)

( * ) Notice: Subject to any disclaimer, the term of this patent is extended or adjusted under 35 U.S.C. 154(b) by 432 days.

(21) Appl. No.: 15/044,831

(22) Filed: Feb. 16, 2016

(65) Prior Publication Data

US 2016/0240293 A1 Aug. 18, 2016

(30) Foreign Application Priority Data

Feb. 16, 2015 (JP) ..... 2015-027368

(51) Int. Cl.

| | |
|---|---|
| ***H01F 1/053*** | (2006.01) |
| ***H01F 41/02*** | (2006.01) |
| ***H01F 1/057*** | (2006.01) |

(52) U.S. Cl.

CPC ..... *H01F 1/0577* (2013.01)

(58) Field of Classification Search

None

See application file for complete search history.

(56) References Cited

U.S. PATENT DOCUMENTS

| | | | | |
|---|---|---|---|---|
| 2009/0019969 | A1 | 1/2009 | Kato et al. | |
| 2010/0231388 | A1 | 9/2010 | Shute et al. | |
| 2014/0065004 | A1 | 3/2014 | Li et al. | |
| 2014/0184370 | A1* | 7/2014 | Hidaka | C22C 33/02 335/302 |

FOREIGN PATENT DOCUMENTS

| | | | |
|---|---|---|---|
| JP | S5946008 | A | 3/1984 |
| JP | 4645855 | B2 | 3/2011 |
| JP | 4831074 | B2 | 12/2011 |

OTHER PUBLICATIONS

U.S. Appl. No. 15/044,383, filed Feb. 16, 2016.
Jun. 11, 2018 Office Action issued in U.S. Appl. No. 15/044,383.

* cited by examiner

*Primary Examiner* — Xiaowei Su
(74) *Attorney, Agent, or Firm* — Oliff PLC

(57) ABSTRACT

A rare earth based permanent magnet has a sintered compact with R-T-B based composition. The compact has two kinds of main phase grains M1 and M2 having different concentration distributions of R including R1 and R2 respectively representing at least one rare earth element including Y and excluding Dy, Tb and Ho, and at least one from Ho, Dy and Tb. M1 and M2 have a core-shell structure containing a shell part coating a core part. In M1, when the R1 and R2 atom concentrations in the core and shell parts are defined as $\alpha R1$, $\alpha R2$, $\beta R1$ and $\beta R2$, respectively, $\alpha R1>\beta R1$, $\alpha R2<\beta R2$, $\alpha R1>\alpha R2$ and $\beta R1<\beta R2$. In M2, when the R1 and R2 atom concentrations in the core and shell parts are defined as $\gamma R1$, $\gamma R2$, $\varepsilon R1$ and $\varepsilon R2$, respectively, $\gamma R1<\varepsilon R1$, $\gamma R2>\varepsilon R2$, $\gamma R1<\gamma R2$ and $\varepsilon R1>\varepsilon R2$. Ratios occupied by the main phase grains having the core-shell structure are 5% or more, respectively.

2 Claims, No Drawings

RARE EARTH BASED PERMANENT MAGNET

The present invention relates to a rare earth based permanent magnet, especially a rare earth based permanent magnet with part of R in the R-T-B based sintered magnet being replaced with heavy rare earth element(s).

BACKGROUND

The R-T-B based sintered magnet (R represents rare earth element(s), T represents Fe or Fe with part of it replaced by Co, and B represents boron) with the tetragonal compound $R_2T_{14}B$ being its main phase is known to have excellent magnetic properties and thus is a representative permanent magnet with high performances since it was invented in 1982 (Patent Document 1).

The R-T-B based sintered magnet with the rare earth element(s) R being composed of Nd, Pr, Dy, Tb and/or Ho has a large magnetic anisotropy field Ha and is preferably used as a permanent magnet material. Especially the Nd—Fe—B based permanent magnet with Nd being the rare earth element R is widely used in consumer, industries, transportation equipments and the like because it has a good balance among the saturation magnetization is, the Curie temperature Tc and magnetic anisotropy field Ha.

The improvement of magnetic properties is required in the conventional R-T-B based permanent magnet. Particularly, a lot of efforts have been taken to improve the residual magnetic flux density Br and the coercivity HcJ. As one of the employed methods, a method is proposed that element(s) having high magnetic anisotropy such as Dy, Tb or the like is/are added to increase the coercivity.

However, from the viewpoints of resource saving and cost reduction, the amount of the added heavy rare earth element(s) is required to be kept to a minimum. As the method for adding the heavy rare earth element(s), for example, a technique involving grain boundary diffusion has been disclosed (Patent Document 2).

As another method for adding the heavy rare earth element(s), a technique has been disclosed in which the RH-T phase (RH represents the heavy rare earth element) is mixed with the RL-T-B phase (RL represents the light rare earth element) or alternatively the RH-T-B phase is mixed with the RL-T-B phase to manufacture the sintered compact (Patent Document 3).

PATENT DOCUMENTS

Patent Document 1: JP-A-S59-46008
Patent Document 2: JP-A-4831074
Patent Document 3: JP-A-4645855

SUMMARY

In recent years, the utilization of the rare earth based magnet covers several aspects, and belter magnetic properties compared to the conventional rare earth based magnet are desired. Especially when the R-T-B based sintered magnet is used in a hybrid vehicle or the like, the magnet is exposed to a relatively high temperature. Thus, the inhibition of the demagnetization at high temperature caused by heat becomes quite important. In order to inhibit the demagnetization at high temperature, the coercivity at room temperature needs to be increased in the R-T-B based sintered magnet.

The present invention is completed in view of the conditions above. For the R-T-B based sintered magnet, the present invention aims to provide a permanent magnet having a higher coercivity compared to that in the prior art.

In order to solve the technical problem mentioned above and reach the aim, the rare earth based permanent magnet of the present invention is characterized as follows. The rare earth based permanent magnet consists of a sintered compact having an R-T-B based composition, wherein the sintered compact contains two kinds of main phase grains M1 and M2 which have different concentration distributions of R, and R contains R1 (R1 represents at least one rare earth element including Y and excluding Dy, Tb and Ho) and R2 (R2 represents at least one from the group consisting of Ho, Dy and Tb) as the necessity. The main phase grain M1 has a core-shell structure which contains a core part and a shell part coating the core part. When the atom concentrations of R1 and R2 in the core part are defined as $\alpha R1$ and $\alpha R2$ respectively and the atom concentrations of R1 and R2 in the shell part are defined as $\beta R1$ and $\beta R2$ respectively, the following conditions are met, i.e., $\alpha R1>\beta R1$, $\alpha R2<\beta R2$, $\alpha R1>\alpha R2$ and $\beta R1<\beta R2$. The main phase grain M2 has a core-shell structure which contains a core part and a shell part coating the core part. When the atom concentrations of R1 and R2 in the core part are defined as $\gamma R1$ and $\gamma R2$ respectively and the atom concentrations of R1 and R2 in the shell part are defined as $\varepsilon R1$ and $\varepsilon R2$ respectively, the following conditions are met, i.e., $\gamma R1<\varepsilon R1$, $\gamma R2>\varepsilon R2$, $\gamma R1<\gamma R2$ and $\varepsilon R1>\varepsilon R2$. Further, relative to all the main phase grains observed at a unit cross-section of the sintered compact, the ratios occupied by the main phase grains both having the core-shell structures are 5% or more respectively.

In the present invention, a unit cross-section in the cross-section of the sintered compact is a region of 50 μm×50 μm.

In the $R_2T_{14}B$ grain (the main phase grain), the part having a concentration difference in the heavy rare earth element(s) of 3 at % or more compared with the outer edge part and containing the center is defined as the core part, and the part of the main phase grain other than the core part is defined as the shell part. The main phase grain having the core part and the shell part is referred to as a core-shell grain. The part with a depth of 0.5 μm from the surface of the main phase grain is defined as the outer edge part, and the shell part contains the outer edge part.

The present inventors have studied whether the R-T-B based sintered magnet has a structure which can exert the high coercivity effect provided by the heavy rare earth element to the largest extent. As a result, it has been found that a high coercivity can be provided when the R-T-B based sintered magnet contains the main phase grains having the core-shell structure mentioned above. The reason is not clear but is presumed by the present inventors as follows. First of all, the high coercivity is thought to be brought by the increased anisotropy magnetic field generated by the addition of the rare earth element(s). Secondly, it is considered that the high coercivity is produced by the pinning effect of the magnetic domain wall generated at the interface between the core part and the shell part. For instance, if quite a lot of the heavy rare earth element(s) is present in the core part and a relatively high amount of the light rare earth element(s) is present in the shell part, the lattice constants will be different between the core part and the shell part. Thus, it is considered that deformation(s) will be generated at the interface between the core part and the shell part. The deformation becomes the pinning site, exerting the inhibitory effect on the movement of the magnetic domain wall. The same will happen when the core part contains a higher amount of the light rare earth element(s) and the shell part contains a higher amount of the heavy rare earth element(s). Thirdly, it is considered that a prevention effect is produced on the decrease of coercivity, wherein the decrease of coercivity is caused by the two kinds of main phase grains contacting with each other. If the main phase grains in the R-T-B based sintered magnets contact with each other, magnetic coupling will occur and the coercivity will decrease substantially. If grain boundary phase is introduced there to surround the main phase grains respectively, the magnetic coupling between the main phase grains will be eliminated. However, it is quite difficult to completely enclose all the main phase grains with the grain boundary phase. In this respect, if a structure is provided in which the main phase grains are manufactured as the M1 grains and the M2 grains, the coercivity can be increased even if M1 contacts with M2. wherein the M1 grain has a core part having a higher amount of the light rare earth element(s) and also a shell part having a higher amount of the heavy rare earth element(s), and the M2 grain has a core part having a higher amount of the heavy rare earth element(s) and also a shell part having a higher amount of the light rare earth element(s). This is because when M1 contacts with M2, the shell part having a higher amount of the light rare earth element(s) contacts with the shell part having a higher amount of the heavy rare earth element(s), leading to a pinning effect that is the same as that at the above core-shell interlace.

In the present invention, when the M1 grain and the M2 grain both having the core-shell structure account for 5% or more respectively, the pinning sites formed by the core-shell structure can be produced and the decrease of coercivity caused by contacting of the main phase grains can be prevented. Therefore, a high coercivity can be provided.

In a preferable embodiment of the present invention, R2 contained in the sintered compact accounts for 11 at % or less.

When the content of the heavy rare earth element is 11 at % or less in the R-T-B based sintered magnet of the present invention, the substantial decrease of the residual magnetic flux density can be prevented. The reason why the residual magnetic flux density is decreased with the addition of the heavy rare earth element(s) is considered to be the decrease of magnetization, wherein the decrease of magnetization is caused by the anti-parallel coupling of the magnetic moment of the heavy rare earth element(s) and the magnetic moment of Nd or Fe. The present invention has been finished in view of the findings above.

As described above, the R-T-B based sintered magnet according to the present invention has a higher coercivity than the conventional ones.

DETAILED DESCRIPTION OF EMBODIMENTS

Hereinafter, the present invention will be described in detail based on embodiments. However, the present invention is not limited to the following embodiments and examples. In addition, the constituent elements in the embodiments and examples described below include those can be easily thought of by those skilled in the art, those substantially the same and those with so-called equivalent scopes. Further, the constituent elements disclosed in the embodiments and examples described below be properly used in combination or alternatively can be appropriately selected.

The R-T-B based sintered magnet of the present embodiment contains 11 to 18 at % of the rare earth element(s) (R). If the content of R is less than 11 at %, the generation of $R_2T_{14}B$ phases (which constitute the main phase of the R-T-B based sintered magnet) will not be complete and α-Fe or the like which possesses soft magnetism will be precipitated. Thus, the coercivity significantly decreases. On the other hand, if the content of R is higher than 18 at %, the volume ratio occupied by the $R_2T_{14}B$ main phase decreases and the residual magnetic flux density will decrease. In addition, R reacts with oxygen, and thus the content of oxygen will increase. With this, the R-rich phase which helps the generation of coercivity will be less, leading to the decrease of the coercivity.

In the present embodiment, the rare earth element(s) (R) contains R1 and R2. However, R1 and R2 are both necessary, wherein R1 represents at least one rare earth element including Y and excluding Dy, Tb and Ho, and R2 represents at least one from the group consisting of Dy, Tb and Ho. Preferably, relative to the total content of the rare earth element(s) (TRE), the ratio of R1 to TRE is 30 to 92 weight % and the ratio of R2 to TRE is 8 to 70 weight %. Here, R may also contain some other component(s) from the impurity of the raw material or the impurity mixed during manufacturing.

The R-T-B based sintered magnet of the present embodiment contains 5 to 8 at % of boron (B). When less than 5 at % of B is contained, no high coercivity can be provided. On the other hand, if more than 8 at % of B is contained, the residual magnetic flux density tends to decrease. Thus, the upper limit of B is set at 8 at %.

The R-T-B based sintered magnet of the present invention contains 74 to 83 at % of the transition metal element T. In the present invention, T contains Fe as the essential element and may contain 4.0 at % or less of Co. Co forms the same phase as Fe while it contributes to the increase of the Curie temperature and the improvement of corrosion resistance of the grain boundary phase. In addition, the R-T-B based sintered magnet which can be used in the present invention may contain either Al or Cu or both in an amount of 0.01 to 1.2 at %. If either Al or Co or both is contained in such a range, the obtained sintered magnet can have a high coercivity, good corrosion resistance and improved temperature properties.

The R-T-B based sintered magnet of the present embodiment may contain other element(s). For example, the element such as Zr, Ti, Bi, Sn, Ga, Nb, Ta, Si, V, Ag, Ge or the like can be properly contained. On the other hand, it is preferable that the content of the impurity element(s) such as oxygen, nitrogen, carbon and the like is declined to the minimum. Especially for oxygen which is harmful to the magnetic properties, its content is preferably set at 5000 ppm or less and more preferably set at 3000 ppm or less. It is because that if the content of oxygen is high, the non-magnetic phase of oxides of the rare earth element(s) will increase, resulting in the deterioration of magnetic properties.

In the R-T-B based sintered magnet of the present embodiment, in addition to the $R_2T_{14}B$ main phase grains, there is a complex structure composed of the eutectic compositions such as the R-rich phase, the B-rich phase and the like which are referred to as the grain boundary phase. The size of the main phase grains is approximately 1 to 10 μm.

Hereinafter, the preferable example of the manufacturing method in the present invention will be described.

During the manufacture of the R-T-B based sintered magnet of the present embodiment, alloy raw materials are prepared to provide the R1-T-B based magnet and the R2-T-B based magnet with desired compositions, respectively. The alloy raw materials can be manufactured by a strip casting method or other well-known melting methods under vacuum or in an inert atmosphere preferably Ar atmosphere. In the strip casting method, the metal raw material is melted under the nonoxidizing atmosphere such as Ar atmosphere and the obtained molten metal is sprayed to the surface of a rotating roll. The molten metal quenched on the roll will be solidified into a thin plate or a sheet (a scale-like shape). The quenched and solidified alloy is then provided with a homogeneous structure having a grain size of 1 to 50 μm. In addition to the strip casting method, the alloy raw material can also be obtained by some melting methods such as the high frequency induction melting method. In addition, in order to prevent the segregation from happening after the melting process, the molten metal can be poured onto a water-cooled copper plate so as to be solidified. Further, the alloy obtained by the reduction-diffusion method can be used as the alloy raw material.

The obtained R1-T-B based alloy raw material and the R2-T-B based alloy raw material are mixed and then subjected to the pulverization step. The mixing ratio can be properly adjusted in accordance with the target composition to be obtained after mixing or the like. Preferably, the weight ratio occupied by the R1-T-B based alloy is 30 to 92% and that occupied by the R2-T-B based alloy is K to 70%. The pulverization step includes a coarse pulverization step and a fine pulverization step. First of all, the alloy raw material is coarsely pulverized to have a particle size of approximately several hundreds of μm. The coarse pulverization is preferably performed in an inert atmosphere by using a stamp mill, a jaw crusher, a Braun mill or the like. Before the coarse pulverization, it is effective to perform the pulverization by storing hydrogen into the alloy raw material and then releasing the hydrogen. The hydrogen releasing treatment is performed to reduce the hydrogen which may turn to be an impurity for the rare earth based sintered magnet. The heating and holding temperature for hydrogen storage is set at 200° C. or higher and preferably 350° C. or higher. The holding time varies depending on the relationship with the holding temperature, the thickness of the alloy raw material and the like. However, it lasts for at least 30 minutes or longer and preferably for 1 hour or longer. The hydrogen releasing treatment is performed under vacuum or in an Ar gas flow. In addition, the hydrogen storing treatment and the hydrogen releasing treatment are not necessary treatments. Alternatively, the hydrogen pulverization can be deemed as the coarse pulverization, and thus the mechanical coarse pulverization can be omitted.

After the coarse pulverization, the alloy is transferred to the fine pulverization step. In the fine pulverization, a jet mill is mainly used to turn the coarsely pulverized powder having a particle size of several hundreds of μm into a powder with an average particle size of 2.5 to 6 μm and preferably 3 to 5 μm. The jet mill performs the following pulverization process. The jet mill ejects an inert gas with a high pressure through a narrow nozzle to provide a high-speeded gas flow. The coarsely pulverized powder is accelerated by this high-speeded gas flow, causing a collision between the coarsely pulverized powders or a collision between the coarsely pulverized powders and a target or the wall of a container.

A wet pulverization can also be used in the fine pulverization. In the wet pulverization, a ball mill or a wet attritor or the like can be used to turn the coarsely pulverized powder having a particle size of several hundred of μm into a powder with an average particle size of 1.5 to 5 μm and preferably 2 to 4.5 μm. In the wet pulverization, an appropriate dispersion medium is selected and the pulverization is performed with the powder of the magnet not contacting with oxygen. In this respect, a finely pulverized powder can be obtained with a low concentration of oxygen.

In order to improve the lubricity of the powder and help the powder to orient more easily in the pressing step, about 0.01 to 0.3 wt % of fatty acids or the derivatives thereof or hydrocarbons can be added during the fine pulverization. These fatty acids or the derivatives thereof or hydrocarbons can be, for example, zinc stearate, calcium stearate, aluminium stearate, Stearamide, Oleamide, ethylene bisstearamide which are the stearic acid-based or oleic acid-based compounds; paraffin and naphthalene which are hydrocarbons; and the like.

The fine powders mentioned above are subjected to a pressing step in a magnetic field. The pressure during the pressing in the magnetic field can be set to be 0.3 to 3 ton/cm$^2$, i.e., 30 to 300 MPa. The pressure can be constant from the beginning to the end, or can be increasing or decreasing gradually, or can be changing irregularly. The lower the pressure is, the better the orientation will be. However, if the pressure is much too low, problems will arise during the handling due to insufficient strength of the green compact. From this point, the pressure should be selected from the range mentioned above. The final relative density of the green compact obtained by pressing in the magnetic field is usually 40 to 60%.

The magnetic field to be applied can be set at approximately 10 to 20 kOe, i.e., 960 to 1600 kA/m. The applied magnetic field is not limited to the static magnetic field, and it also can be a pulsed magnetic field. In addition, the static magnetic field and the pulsed magnetic field can be used in combination.

Then, the green compact is sintered under vacuum or in an inert gas atmosphere. The sintering temperature should be adjusted depending on the conditions such as the composition, the pulverization method, the average particle size, the particle size distribution and the like. In the present invention, the green compact is sintered at 850 to 950° C. With such a sintering temperature, the light rare earth element(s) will diffuse readily while the heavy rare earth element(s) is hard to diffuse. Thus, only the light rare earth element(s) diffuse widely. In the shell part of the R2-T-B main phase (R2 represents at least one from the group consisting of Dy, Tb and Ho), the light rare earth element(s) concentrates, and thus the structure of M2 can be obtained. If the sintering temperature is 1000° C. or higher, both the light rare earth element(s) and the heavy rate earth element(s) will diffuse widely, and thus no desired structure will be provided. Further, if the temperature is lower than 850° C., the temperature will be not sufficient for diffusion and thus the desired structure will not be obtained.

The time for the sintering step should be adjusted depending on the conditions such as the composition, the pulverization method, the average particle size and particle size distribution and the like. It can be set as 48 to 96 hours. If the time is shorter than 48 hours, the light rare earth element(s) cannot sufficiently diffuse so that the desired core-shell structure cannot be manufactured. In addition, if the time is longer than 96 hours, the main phase grains grow, leading to a substantial decrease of the coercivity. The main phase grains in the sintered compact are preferably 10 μm or smaller in size.

After sintered, the obtained sintered compact is further subjected to a heat treatment This step is crucial to the structure of M1. The temperature during the heat treatment is 1100 to 1200° C. Such a temperature is the temperature for the heavy rare earth element(s) to diffuse, and the heavy rare earth element(s) concentrate in the shell part of the R1-T-B main phase. In this way, the structure of M1 can be obtained. if the temperature is 1100° C. or lower, the heavy rare earth element(s) will not diffuse so that the desired structure cannot be provided. On the other hand, a temperature of 1200° C. or higher is above the melting point of the sintered compact and will not result in the desired structure. The time for the heat treatment is 5 minutes to 15 minutes. If the time lasts for 5 minutes or shorter, the desired structure cannot be provided due to the insufficient diffusion of the heavy rare earth element(s). If the time lasts for 15 minutes or longer, the main phase grains grow, leading to a substantial decrease of coercivity.

After sintered, the obtained sintered compact can be subjected to an aging treatment. This step is crucial for the control of the coercivity. When the aging treatment is performed in two-step, it will be effective to last for a required time at about 800° C. and then about 600° C. respectively. If a heat treatment is performed at around 800° C. after the sintering step, the coercivity will increase. Thus, it is especially effective in the mixing method. In addition, as a heat treatment at around 600° C. greatly elevates the coercivity, the aging treatment can be performed at approximately 600° C. when the aging treatment is to be perforated in one-step.

EXAMPLES

Hereinafter, the present invention will be described in detail based on the examples and comparative examples. However, the present invention is not limited to the following examples.

Examples 1 to 3

In order to prepare the R1-T-B based alloy and the R2-T-B based alloy, metals or alloy raw materials were mixed together to provide raw materials having the compositions listed in Table 1. Then, they were melted and then casted by the strip casting method to provide alloy sheets respectively. In Examples 1 to 3, Dy, Tb and Ho were used as R2, respectively. The detailed compositions were listed in Table 1.

fine pulverization under a high pressure in a nitrogen atmosphere respectively so that the finely pulverized powders were obtained.

Thereafter, the finely pulverized powders were put into a press mold and then pressed in the magnetic field. In specific, the pressing step was performed in a magnetic field of 15 kOe under a pressure of 140 MPa. In this respect, green compacts of 20 mm×18 mm×13 mm were obtained. The direction of the magnetic field was perpendicular to the direction in which the powders were pressed. The obtained green compacts were sintered at 850° C. for 48 hours. Then, they were subjected to a heat treatment for 15 minutes at 1200° C. to provide the sintered compacts. The sintered compacts were then provided with an aging treatment for 1 hour at 600° C.

The obtained sintered compacts were measured for the residual magnetic flux density (Br) and the coercivity (HcJ) by using a BH tracer. The results were shown in Table 3.

The obtained sintered compacts were cut down in a direction parallel to axis of easy magnetization and then resin-embedded into the epoxy resin. The cross-sections were polished using commercially available sandpapers, wherein the grit size of the sandpaper gradually became larger. At last, the cross-sections were polished by buff and diamond wheels. Here, the polishing step was performed without any water added. If water was used, the components in the grain boundary phase would be eroded.

The cross-sections of the sintered compacts were subjected to an ion milling to eliminate the influence of the oxide film or the nitride film on the outmost surface. Then, the cross-sections of the R-T-B based sintered magnet were observed by the EPMA (Electron Probe Micro Analyzer) and then analyzed. An area of 50 μm×50 μm was used as a unit cross-section and was subjected to the element mapping by EPMA (256 points×256 points). Here, the site to be observed in the cross-section was random. In this way. the main phase grains and the gram boundaries were determined. Also, to all of the main phase grains that can be identified in the unit cross-section area, it was determined that whether the core-shell structure was present. Further, the M1 grains with concentrated light rare earth element(s) in the core part and the M2 grains with concentrated heavy rare earth element(s) in the core part were identified, and the compositions of each core part and each shell part were determined.

TABLE 1

| | | TRE [at %] | Nd [at %] | Pr [at %] | La [at %] | Ce [at %] | Y [at %] | Dy [at %] | Tb [at %] | Ho [at %] | Fe [at %] | B [at %] | Co [at %] | Cu [at %] | Al [at %] | Mixing ratio [wt %] | Concentration of R2 after mixing [at %] |
|---|---|---|---|---|---|---|---|---|---|---|---|---|---|---|---|---|---|
| Example 1 | R1—Fe—B | 14.9 | 14.9 | 0.00 | 0.00 | 0.00 | 0.00 | 0.00 | 0.00 | 0.00 | 75.7 | 5.41 | 2.00 | 1.00 | 1.00 | 92 | 1.19 |
| | R2—Fe—B | 14.9 | 0.00 | 0.00 | 0.00 | 0.00 | 0.00 | 14.9 | 0.00 | 0.00 | 75.7 | 5.41 | 2.00 | 1.00 | 1.00 | 8 | |
| | Composition after mixing | 14.9 | 13.7 | 0.00 | 0.00 | 0.00 | 0.00 | 1.19 | 0.00 | 0.00 | 75.7 | 5.41 | 2.00 | 1.00 | 1.00 | — | |
| Example 2 | R1—Fe—B | 14.9 | 14.9 | 0.00 | 0.00 | 0.00 | 0.00 | 0.00 | 0.00 | 0.00 | 75.7 | 5.41 | 2.00 | 1.00 | 1.00 | 92 | 1.19 |
| | R2—Fe—B | 14.9 | 0.00 | 0.00 | 0.00 | 0.00 | 0.00 | 0.00 | 14.9 | 0.00 | 75.7 | 5.41 | 2.00 | 1.00 | 1.00 | 8 | |
| | Composition after mixing | 14.9 | 13.7 | 0.00 | 0.00 | 0.00 | 0.00 | 0.00 | 1.19 | 0.00 | 75.7 | 5.41 | 2.00 | 1.00 | 1.00 | — | |
| Example 3 | R1—Fe—B | 14.9 | 7.45 | 3.73 | 3.73 | 0.00 | 0.00 | 0.00 | 0.00 | 0.00 | 75.7 | 5.41 | 2.00 | 1.00 | 1.00 | 92 | 1.19 |
| | R2—Fe—B | 14.9 | 0.00 | 0.00 | 0.00 | 0.00 | 0.00 | 0.00 | 0.00 | 14.9 | 75.7 | 5.41 | 2.00 | 1.00 | 1.00 | 8 | |
| | Composition after mixing | 14.9 | 6.90 | 3.43 | 3.43 | 0.00 | 0.00 | 0.00 | 0.00 | 1.19 | 75.7 | 5.41 | 2.00 | 1.00 | 1.00 | — | |

The obtained two kinds of alloy sheets were mixed in a weight ratio of 92:8 and then subjected to the hydrogen pulverization so as to provide the coarsely pulverized powders. Oleamide was added as the lubricant in an amount of 0.1 wt % into the coarsely pulverized powders respectively. Then, a jet pulverizer (a jet mill) was used to perform the The details for the analyzing method of the main phase grains were described as follows.

(1) According to the backscattered electron image obtained at the unit cross-section, the main phase grain part and the grain boundary part were identified by image analysts method.

(2) Based on the mapping data of the intensities of the characteristic x-ray of R1 and R2 obtained by EPMA, the element concentrations were calculated. The region containing the center of the main phase grain and having a concentration difference in the heavy rare earth element of 3% or more compared with the outer edge part of the main phase grain was defined as the core part, and the part other than the core part was defined as the shell part. Here, the core-shell gains with a higher concentration of the light rare earth element in the core part than the shell part were defined as the M1 grains, and the core-shell gains with a higher concentration of the heavy rare earth element in the shell part than the core part were defined as the M2 grains. For one visual field, the total grain number (D), the number of M1 grains (E) and the number of M2 grains (F) were investigated. Then, the number ratio occupied by the M1 grains (E/D) and the number ratio occupied by M2 grains (F/D) in one visual field were calculated.

(3) The foregoing operations (1) and (2) were done in 20 visual fields in one cross-section of a single sample. The average concentrations of the rare earth element(s) in the core part of the M1 grain (αR1 and αR2), the average concentrations of the rare earth element(s) in the shell part of the M1 grain (βR1 and βR2), the average concentrations of the rare earth element(s) in the core part of the M2 grain (γR1 and γR2), and the average concentrations of the rare earth element(s) in the shell part of the M2 grain (εR1 and εR2) were calculated. Then, the average value of the ratio occupied by the M1 grains per visual field was determined as well as the average value of ratio occupied by M2 grains per visual field.

Comparative Example 1

In order to prepare the R1-T-B based alloy, metals or alloy raw materials were mixed together to provide the raw material having the composition as shown in Table 2. Then, they were melted and then casted by the strip casting method to provide alloy sheets.

TABLE 2

| | | TRE [at %] | Nd [at %] | Pr [at %] | La [at %] | Ce [at %] | Y [at %] | Dy [at %] | Tb [at %] | Ho [at %] | Fe [at %] | B [at %] | Co [at %] | Cu [at %] | Al [at %] |
|---|---|---|---|---|---|---|---|---|---|---|---|---|---|---|---|
| Comparative Example 1 | R1—Fe—B | 14.9 | 14.9 | 0.00 | 0.00 | 0.00 | 0.00 | 0.00 | 0.00 | 0.00 | 75.7 | 5.41 | 2.00 | 1.00 | 1.00 |

The obtained alloy sheets were subjected to the hydrogen pulverization so as to provide a coarsely pulverized powder. Oleamide was added as the lubricant in an amount of 0.1 wt % into the coarsely pulverized powder. Then, a jet pulverizer (a jet mill) was used to perform the fine pulverization under a high pressure in a nitrogen atmosphere so that the finely pulverized powder was obtained.

Thereafter, the prepared R1-T-B based alloy powder was put into a press mold and then pressed in the magnetic field. In specific, the pressing step was performed in a magnetic field of 15 kOe under a pressure of 140 MPa. In this respect, a green compact of 20 mm×18 mm×13 mm was obtained. The direction of the magnetic field was perpendicular to the direction in which the powder was pressed. The obtained green compact was sintered at 1050° C. for 12 hours. Then, it was subjected to an aging treatment for 1 hour at 600° C. to provide a sintered compact.

The obtained sintered compact was measured for the residual magnetic flux density (Br) and the coercivity (HcJ) by using a BH tracer. The results were shown in Table 3.

TABLE 3

| | Element(s) of R1 | Element(s) of R2 | M1 grain [%] | M2 grain [%] | Core part of M1 [at %] αR1 | Core part of M1 [at %] αR2 | Shell part of M1 [at %] βR1 | Shell part of M1 [at %] βR2 | Core part of M2 [at %] γR1 | Core part of M2 [at %] γR2 | Shell part of M2 [at %] εR1 | Shell part of M2 [at %] εR2 | Br [kG] | HcJ [kOe] |
|---|---|---|---|---|---|---|---|---|---|---|---|---|---|---|
| Comparative Example 1 | Nd | — | 0.0 | 0.0 | — | — | — | — | — | — | — | — | 14.2 | 12.2 |
| Example 1 | Nd | Dy | 7.2 | 8.1 | 11.7 | 1.3 | 1.2 | 11.5 | 1.1 | 11.6 | 11.4 | 1.5 | 13.5 | 25.2 |
| Example 2 | Nd | Tb | 7.1 | 7.9 | 11.5 | 1.3 | 1.1 | 11.4 | 1.2 | 11.5 | 11.3 | 1.7 | 13.4 | 25.3 |
| Example 3 | Nd | Ho | 7.3 | 8.0 | 11.4 | 1.2 | 1.4 | 11.5 | 1.3 | 11.7 | 11.1 | 1.4 | 13.3 | 25.4 |

In Examples 1 to 3, the main phase grain M1 having a core-shell structure and the main phase grain M2 having a core-shell structure were both present, wherein the core part of the main phase grain M1 had a higher atom concentration of the light rare earth element(s) R1 and the shell part had a higher atom concentration of the heavy rare earth element(s) R2, and the core part of the main phase grain M2 had a higher atom concentration of the heavy rare earth element(s) R2 and the shell part had a higher atom concentration of the light rare earth element(s) R1. In addition, the coercivities of the three Examples were higher than that in Nd—Fe—B from Comparative Example 1 where no heavy rare earth element was added. As described above, such an effect considered to be produced by the effects caused by the addition of the heavy rare earth element(s) and the presence of the core-shell structures, i.e., the increase of the magnetic anisotropy field, the deformation-induced pinning effect as well as the reduction of the lattice defect-caused influence.

Examples 4 to 7

The preparation of the alloy sheets, pulverization, pressing, sintering and evaluation were similarly performed as in Example 1 except that Pr, Y, Ce or La was further used as the light rare earth element R1. The compositions were listed in Table 4 and the evaluation results of the magnetic characteristics were shown in Table 5.

TABLE 4

| | | TRE [at %] | Nd [at %] | Pr [at %] | La [at %] | Ce [at %] | Y [at %] | Dy [at %] | Tb [at %] | Ho [at %] | Fe [at %] | B [at %] | Co [at %] | Cu [at %] | Al [at %] | Mixing ratio [wt %] | Concentration of R2 after mixing [at %] |
|---|---|---|---|---|---|---|---|---|---|---|---|---|---|---|---|---|---|
| Example 4 | R1—Fe—B | 14.9 | 7.45 | 3.73 | 3.73 | 0.00 | 0.00 | 0.00 | 0.00 | 0.00 | 75.7 | 5.41 | 2.00 | 1.00 | 1.00 | 92 | 1.19 |
| | R2—Fe—B | 14.9 | 0.00 | 0.00 | 0.00 | 0.00 | 0.00 | 14.9 | 0.00 | 0.00 | 75.7 | 5.41 | 2.00 | 1.00 | 1.00 | 8 | |
| | Composition after mixing | 14.9 | 6.85 | 3.43 | 3.43 | 0.00 | 0.00 | 1.19 | 0.00 | 0.00 | 75.7 | 5.41 | 2.00 | 1.00 | 1.00 | — | |
| Example 5 | R1—Fe—B | 14.9 | 7.45 | 0.00 | 3.73 | 3.73 | 0.00 | 0.00 | 0.00 | 0.00 | 75.7 | 5.41 | 2.00 | 1.00 | 1.00 | 92 | 1.19 |
| | R2—Fe—B | 14.9 | 0.00 | 0.00 | 0.00 | 0.00 | 0.00 | 14.9 | 0.00 | 0.00 | 75.7 | 5.41 | 2.00 | 1.00 | 1.00 | 8 | |
| | Composition after mixing | 14.9 | 6.85 | 0.00 | 3.43 | 3.43 | 0.00 | 1.19 | 0.00 | 0.00 | 75.7 | 5.41 | 2.00 | 1.00 | 1.00 | — | |
| Example 6 | R1—Fe—B | 14.9 | 7.45 | 0.00 | 0.00 | 3.73 | 3.73 | 0.00 | 0.00 | 0.00 | 75.7 | 5.41 | 2.00 | 1.00 | 1.00 | 92 | 1.19 |
| | R2—Fe—B | 14.9 | 0.00 | 0.00 | 0.00 | 0.00 | 0.00 | 14.9 | 0.00 | 0.00 | 75.7 | 5.41 | 2.00 | 1.00 | 1.00 | 8 | |
| | Composition after mixing | 14.9 | 6.85 | 0.00 | 0.00 | 3.43 | 3.43 | 1.19 | 0.00 | 0.00 | 75.7 | 5.41 | 2.00 | 1.00 | 1.00 | — | |
| Example 7 | R1—Fe—B | 14.9 | 7.45 | 3.73 | 0.00 | 3.73 | 0.00 | 0.00 | 0.00 | 0.00 | 75.7 | 5.41 | 2.00 | 1.00 | 1.00 | 92 | 1.19 |
| | R2—Fe—B | 14.9 | 0.00 | 0.00 | 0.00 | 0.00 | 0.00 | 14.9 | 0.00 | 0.00 | 75.7 | 5.41 | 2.00 | 1.00 | 1.00 | 8 | |
| | Composition after mixing | 14.9 | 6.85 | 3.43 | 0.00 | 3.43 | 0.00 | 1.19 | 0.00 | 0.00 | 75.7 | 5.41 | 2.00 | 1.00 | 1.00 | — | |

TABLE 5

| | Element(s) of R1 | Element(s) of R2 | M1 grain [%] | M2 grain [%] | Core part of M1 [at %] | | Shell part of M1 [at %] | | Core part of M2 [at %] | | Shell part of M2 [at %] | | Br [kG] | HcJ [kOe] |
|---|---|---|---|---|---|---|---|---|---|---|---|---|---|---|
| | | | | | αR1 | αR2 | βR1 | βR2 | γR1 | γR2 | εR1 | εR2 | | |
| Example 4 | Nd, Pr, La | Dy | 7.1 | 8.2 | 11.5 | 1.2 | 1.1 | 11.4 | 1.0 | 11.8 | 11.5 | 1.4 | 13.2 | 24.9 |
| Example 5 | Nd, La, Ce | Dy | 7.0 | 8.5 | 11.4 | 1.1 | 1.0 | 11.3 | 0.9 | 11.7 | 11.4 | 1.3 | 13.1 | 25.2 |
| Example 6 | Nd, Ce, Y | Dy | 7.4 | 7.9 | 11.3 | 1.0 | 0.9 | 11.2 | 0.8 | 11.5 | 11.2 | 1.1 | 13.2 | 24.2 |
| Example 7 | Nd, Pr, Ce | Dy | 6.9 | 8.1 | 11.2 | 0.9 | 0.8 | 11.1 | 0.7 | 11.4 | 11.1 | 1.0 | 13.1 | 23.4 |

In Examples 4 to 7, the M1 grain and the M2 grain were simultaneously present, and thus high coercivities were provided. Thus, it could be confirmed that the core-shell structure and the high coercivity might be similarly provided as in Example 1 even if light rare earth elements other than Nd were introduced as R1.

Comparative Example 2

In order to prepare the R1-T-B based alloy and the R2-T based alloy, metals or alloy raw materials were mixed together to provide the raw materials having the compositions listed in Table 6. They were melted and then casted by the strip casting method to provide alloy sheets. Then, the R1-T-B based alloy and the R2-T based alloy were mixed in a weight ratio of 93:7, and the pulverization, pressing, sintering and evaluation were similarly performed as in Example 1.

Comparative Example 3

In order to prepare the R1-R2-T-B based alloy, metals or alloy raw materials were mixed together to provide the raw material having the composition listed in Table 6. They were melted and then casted by the strip casting method to provide alloy sheets. Then, the pulverization, pressing, sintering and evaluation were similarly performed as in Example 1. The results were shown in Table 7.

TABLE 6

| | | TRE [at %] | Nd [at %] | Tb [at %] | Ho [at %] | Dy [at %] | Fe [at %] | B [at %] | Co [at %] | Cu [at %] | Al [at %] | Concentration of R2 after mixing [at %] |
|---|---|---|---|---|---|---|---|---|---|---|---|---|
| Example 1 | R1—Fe—B | 14.9 | 14.9 | 0.00 | 0.00 | 0.00 | 75.7 | 5.41 | 2.00 | 1.00 | 1.00 | 1.19 |
| | R2—Fe—B | 14.9 | 0.00 | 0.00 | 0.00 | 14.9 | 75.7 | 5.41 | 2.00 | 1.00 | 1.00 | |
| | Composition after mixing | 14.9 | 13.7 | 0.00 | 0.00 | 1.19 | 75.7 | 5.41 | 2.00 | 1.00 | 1.00 | |
| Comparative Example 2 | R1—Fe—B | 14.7 | 14.7 | 0.00 | 0.00 | 0.00 | 75.4 | 5.82 | 2.00 | 1.00 | 1.00 | |
| | R2—Fe | 17.0 | 0.00 | 0.00 | 0.00 | 17.0 | 79.0 | 0.00 | 2.00 | 1.00 | 1.00 | |
| | Composition after mixing | 14.9 | 13.7 | 0.00 | 0.00 | 1.19 | 75.7 | 5.41 | 2.00 | 1.00 | 1.00 | |
| Comparative Example 3 | | 14.9 | 13.7 | 0.00 | 0.00 | 1.19 | 75.7 | 5.41 | 2.00 | 1.00 | 1.00 | — |

TABLE 7

| | Element(s) of R1 | Element(s) of R2 | M1 grain [%] | M2 grain [%] | Core part of M1 [at %] αR1 | Core part of M1 [at %] αR2 | Shell part of M1 [at %] βR1 | Shell part of M1 [at %] βR2 | Core part of M2 [at %] γR1 | Core part of M2 [at %] γR2 | Shell part of M2 [at %] εR1 | Shell part of M2 [at %] εR2 | Br [kG] | HcJ [kOe] |
|---|---|---|---|---|---|---|---|---|---|---|---|---|---|---|
| Comparative Example 1 | Nd | — | 0.0 | 0.0 | — | — | — | — | — | — | — | — | 14.2 | 12.2 |
| Example 1 | Nd | Dy | 7.2 | 8.1 | 11.7 | 1.3 | 1.2 | 11.5 | 1.1 | 11.6 | 11.4 | 1.5 | 13.5 | 25.2 |
| Comparative Example 2 | Nd | Dy | 0.0 | 6.7 | 11.7 | 0.9 | 11.4 | 1.3 | — | — | — | — | 13.5 | 17.1 |
| Comparative Example 3 | Nd | Dy | 0.0 | 0.0 | — | — | — | — | — | — | — | — | 13.2 | 15.2 |

In Comparative Example 2, only M1 was the main phase grain having a core-shell structure. And the coercivity was lower than that in Example 1. In Comparative Example 3, no core-shell structure had been found, and the coercivity was lower than that in Example 1.

Comparative Examples 4~17, Examples 8~13

The manufacture of the alloy sheets, pulverization, pressing, sintering and evaluation were similarly performed as in Example 1 except that the sintering temperature and the heat treatment temperature were different. The sintering temperature and the heat treatment temperature were shown in Table 8. The compositions were the same as in Example 1.

TABLE 8

| | Sintering temperature [° C.] | Heat treatment temperature [° C.] | M1 grain [%] | M2 grain [%] | Core part of M1 [at %] αR1 | Core part of M1 [at %] αR2 | Shell part of M1 [at %] βR1 | Shell part of M1 [at %] βR2 | Core part of M2 [at %] γR1 | Core part of M2 [at %] γR2 | Shell part of M2 [at %] εR1 | Shell part of M2 [at %] εR2 | Br [kG] | HcJ [kOe] |
|---|---|---|---|---|---|---|---|---|---|---|---|---|---|---|
| Comparative Example 4 | 800 | 1050 | 0.00 | 0.00 | — | — | — | — | — | — | — | — | 13.2 | 15.4 |
| Comparative Example 5 | 800 | 1100 | 9.1 | 0.0 | 11.3 | 1.1 | 1.6 | 11.0 | — | — | — | — | 13.1 | 17.7 |
| Comparative Example 6 | 800 | 1150 | 8.8 | 0.0 | 11.3 | 1.5 | 1.2 | 11.5 | — | — | — | — | 13.0 | 17.5 |
| Comparative Example 7 | 800 | 1200 | 8.9 | 0.0 | 11.9 | 1.2 | 1.1 | 11.5 | — | — | — | — | 13.2 | 17.7 |
| Comparative Example 8 | 800 | 1250 | 0.0 | 0.0 | — | — | — | — | — | — | — | — | 13.1 | 15.6 |
| Comparative Example 9 | 850 | 1050 | 0.0 | 7.8 | — | — | — | — | 1.8 | 11.8 | 11.4 | 2.0 | 13.5 | 21.4 |
| Example 8 | 850 | 1100 | 7.2 | 7.9 | 11.6 | 1.9 | 1.7 | 11.3 | 1.0 | 11.9 | 11.0 | 1.6 | 13.3 | 25.5 |
| Example 9 | 850 | 1150 | 7.1 | 8.1 | 11.4 | 1.8 | 1.7 | 11.5 | 1.2 | 11.8 | 11.9 | 1.1 | 13.4 | 26.8 |
| Example 10 | 850 | 1200 | 7.2 | 8.8 | 11.7 | 1.3 | 1.2 | 11.5 | 1.1 | 11.6 | 11.4 | 1.5 | 13.5 | 25.2 |
| Comparative Example 10 | 850 | 1250 | 0.0 | 0.0 | — | — | — | — | — | — | — | — | 13.2 | 15.2 |
| Comparative Example 11 | 950 | 1050 | 0.0 | 7.5 | — | — | — | — | 1.7 | 11.3 | 12.0 | 1.0 | 13.1 | 21.5 |
| Example 11 | 950 | 1100 | 6.9 | 7.9 | 11.4 | 1.3 | 1.6 | 11.7 | 1.0 | 11.5 | 11.4 | 1.2 | 13.1 | 25.7 |
| Example 12 | 950 | 1150 | 6.5 | 8.8 | 11.9 | 1.7 | 2.0 | 11.8 | 1.3 | 11.7 | 11.6 | 1.6 | 13.1 | 26.8 |
| Example 13 | 950 | 1200 | 6.7 | 9.1 | 11.3 | 1.6 | 1.9 | 11.4 | 1.6 | 11.7 | 11.4 | 1.7 | 13.5 | 25.4 |
| Comparative Example 12 | 950 | 1250 | 0.0 | 0.0 | — | — | — | — | — | — | — | — | 13.1 | 15.3 |
| Comparative Example 13 | 1000 | 1050 | 0.0 | 0.0 | — | — | — | — | — | — | — | — | 13.1 | 15.8 |
| Comparative Example 14 | 1000 | 1100 | 7.5 | 0.0 | 11.2 | 1.6 | 1.3 | 11.8 | — | — | — | — | 13.2 | 17.5 |
| Comparative Example 15 | 1000 | 1150 | 7.6 | 0.0 | 11.2 | 1.1 | 1.6 | 11.8 | — | — | — | — | 13.1 | 17.2 |
| Comparative Example 16 | 1000 | 1200 | 7.8 | 0.0 | 12.0 | 1.0 | 1.7 | 11.7 | — | — | — | — | 13.0 | 17.6 |
| Comparative Example 17 | 1000 | 1250 | 0.0 | 0.0 | — | — | — | — | — | — | — | — | 13.0 | 15.4 |

In Examples 8 to 13 where the sintering temperature was 850 to 950° C. and the heat treatment temperature was 1100 to 1200° C. the M1 grain and the M2 grain were both generated and high coercivities were provided, wherein the M1 grain had a core with a higher amount of the light rare earth element(s) and the M2 grain had a core with a higher amount of the heavy rare earth element(s). In Comparative Examples 1 to 7 with the sintering temperature of 800° C., no M2 grain was generated, and no high coercivity was provided. The reason might be that the temperature was much too low and thus the light rare earth element had not sufficiently diffused. Similarly, in Comparative Examples 13 to 16 with the sintering temperature of 1000° C., no M2grain was generated and no high coercivity was provided, either. The reason was considered as follows. That is, the sintering temperature was so high that the light rare earth element uniformly diffused into the whole sintered compact. In Comparative Examples 9 and 11 with the heat treatment temperature of 1050° C. no M1 grain was generated, and no high coercivity was provided. On the other hand, in Comparative Examples 8, 10, 12 and 17 where the heat treatment temperature was 1250° C., neither M1 grain nor M2 grain was generated, and a low coercivity was provided. The reason was considered as follows. Since the heat treatment temperature was much too high, the sintered compact had been melted.

Comparative Examples 18 to 29 and Examples 14 to 17

The manufacture of the alloy sheets, pulverization, pressing and sintering were similarly performed as in Example 1 except that the sintering time and the heat treatment time were different. The sintering time and the heat treatment time were shown in Table 9. The compositions were the same as that in Example 1.

Then, for the obtained sintered compacts, the manufacture of the alloy sheets, pulverization, pressing, sintering and evaluation were similarly performed as in Example 1. The results were shown in Table 9.

TABLE 9

| | Sintering time | Heat treatment time | Core part of M1 [at %] | | Shell part of M1 [at %] | | Core part of M2 [at %] | | Shell part of M2 [at %] | | Br | HcJ | M1 grain | M2 grain |
|---|---|---|---|---|---|---|---|---|---|---|---|---|---|---|
| | [h] | [min] | αR1 | αR2 | βR1 | βR2 | γR1 | γR2 | εR1 | εR2 | [kG] | [kOe] | [%] | [%] |
| Comparative Example 18 | 24 | 3 | — | — | — | — | — | — | — | — | 13.2 | 15.4 | 0.0 | 0.0 |
| Comparative Example 19 | 24 | 5 | — | — | — | — | 1.6 | 11.6 | 11.6 | 2.0 | 13.3 | 21.0 | 0.0 | 5.0 |
| Comparative Example 20 | 24 | 15 | — | — | — | — | 1.3 | 12 | 11.1 | 1.1 | 13.2 | 22.5 | 0.0 | 8.1 |
| Comparative Example 21 | 24 | 20 | — | — | — | — | 1.8 | 11.6 | 11.9 | 1.2 | 13.0 | 22.5 | 0.0 | 24.2 |
| Comparative Example 22 | 48 | 3 | 11.6 | 1.0 | 1.3 | 11.3 | — | — | — | — | 13.2 | 17.4 | 5.8 | 0.0 |
| Example 14 | 48 | 5 | 11.3 | 1.4 | 1.2 | 11.1 | 1.8 | 11.1 | 11.3 | 1.5 | 13.2 | 26.1 | 6.9 | 5.5 |
| Example 15 | 48 | 15 | 11.7 | 1.3 | 1.2 | 11.5 | 1.1 | 11.6 | 11.4 | 1.5 | 13.5 | 25.2 | 7.2 | 8.1 |
| Comparative Example 23 | 48 | 20 | 11.6 | 2.0 | 1.5 | 11.2 | 1.9 | 11.3 | 11.9 | 1.2 | 13.6 | 15.0 | 12.2 | 25.1 |
| Comparative Example 24 | 96 | 3 | 11.8 | 1.3 | 1.3 | 11.4 | — | — | — | — | 13.1 | 17.1 | 17.3 | 0.0 |
| Example 16 | 96 | 5 | 11.8 | 1.1 | 1.9 | 11.1 | 1.2 | 11.8 | 11.5 | 1.5 | 13.3 | 26.6 | 18.3 | 6.1 |
| Example 17 | 96 | 15 | 11.0 | 1.1 | 2.0 | 11.9 | 1.0 | 11.2 | 12.0 | 1.8 | 13.3 | 26.3 | 18.5 | 7.9 |
| Comparative Example 25 | 96 | 20 | 11.6 | 1.5 | 1.7 | 11.1 | 1.8 | 11.1 | 11.0 | 1.9 | 13.1 | 15.1 | 18.9 | 23.9 |
| Comparative Example 26 | 120 | 3 | 11.7 | 1.4 | 1.8 | 11.6 | — | — | — | — | 13.0 | 15.6 | 24.2 | 0.0 |
| Comparative Example 27 | 120 | 5 | 11.9 | 1.6 | 1.9 | 11.6 | 1.5 | 11.9 | 11.4 | 1.1 | 13.2 | 15.4 | 24.1 | 5.4 |
| Comparative Example 28 | 120 | 15 | 11.8 | 2.0 | 1.5 | 11.9 | 1.2 | 11.8 | 11.8 | 1.1 | 13.1 | 15.6 | 24.0 | 7.8 |
| Comparative Example 29 | 120 | 20 | 11.4 | 1.7 | 1.8 | 11.0 | 1.4 | 11.0 | 11.4 | 1.1 | 13.2 | 15.8 | 24.2 | 24.8 |

In Examples 14 to 17 where the sintering time was set as 48 to 96 hours and the heat treatment time was set as 5 to 15 minutes, the M1 grain and the M2 grain were both generated, and a high coercivity was provided. In Comparative Examples 18 to 21 with 24 hours of sintering, no M1 grain was generated, and no high coercivity was provided. This might due to that the sintering time is so short that the light rare earth element had not sufficiently diffused. Similarly, in Comparative Examples 26 to 29 with 120 hours of sintering or even longer, although the M1 grain and the M2 grain were both generated when the heat treatment lasted for 5 minutes or longer, the coercivity was still low. The reason was considered as follows. The sintering time was too long that grain growth occurred to the main phase grains. If the heat treatment lasted for 3 minutes, no M2 grain was generated and thus no high coercivity was provided, as shown in Comparative Examples 22 and 24.

Further, the M1 grain increased in number when the sintering was prolonged while the M2 grain increased in number when the heat treatment was prolonged.

Comparative Examples 30 to 31 and Examples 18 to 23

The R1-T-B based alloy and the R2-T-B based alloy were similarly manufactured as in Example 1. Then, these two alloys were mixed in a weight ratio of 98:2, 95:5, 92:8, 70:30, 50:50, 30:70, 20:80 and 10:90, respectively, and the pressing and sintering were similarly performed as in Example 1. The compositions after the mixing step were shown in Table 10.

TABLE 10

| | | TRE [at %] | Nd [at %] | Dy [at %] | Tb [at %] | Ho [at %] | Fe [at %] | B [at %] | Co [at %] | Cu [at %] | Al [at %] | Mixing ratio [wt %] | Concentration of R2 after mixing [at %] |
|---|---|---|---|---|---|---|---|---|---|---|---|---|---|
| Comparative Example 30 | R1—Fe—B | 14.9 | 14.9 | 0.00 | 0.00 | 0.00 | 75.7 | 5.41 | 2.00 | 1.00 | 1.00 | 98 | 0.3 |
| | R2—Fe—B | 14.9 | 0.00 | 14.9 | 0.00 | 0.00 | 75.7 | 5.41 | 2.00 | 1.00 | 1.00 | 2 | |
| | Composition after mixing | 14.9 | 14.6 | 0.30 | 0.00 | 0.00 | 75.7 | 5.41 | 2.00 | 1.00 | 1.00 | — | |
| Comparative Example 31 | R1—Fe—B | 14.9 | 14.9 | 0.00 | 0.00 | 0.00 | 75.7 | 5.41 | 2.00 | 1.00 | 1.00 | 95 | 0.75 |
| | R2—Fe—B | 14.9 | 0.00 | 14.9 | 0.00 | 0.00 | 75.7 | 5.41 | 2.00 | 1.00 | 1.00 | 5 | |
| | Composition after mixing | 14.9 | 14.2 | 0.75 | 0.00 | 0.00 | 75.7 | 5.41 | 2.00 | 1.00 | 1.00 | — | |
| Example 18 | R1—Fe—B | 14.9 | 14.9 | 0.00 | 0.00 | 0.00 | 75.7 | 5.41 | 2.00 | 1.00 | 1.00 | 92 | 1.19 |
| | R2—Fe—B | 14.9 | 0.00 | 14.9 | 0.00 | 0.00 | 75.7 | 5.41 | 2.00 | 1.00 | 1.00 | 8 | |
| | Composition after mixing | 14.9 | 13.7 | 1.19 | 0.00 | 0.00 | 75.7 | 5.41 | 2.00 | 1.00 | 1.00 | — | |
| Example 19 | R1—Fe—B | 14.9 | 14.9 | 0.00 | 0.00 | 0.00 | 75.7 | 5.41 | 2.00 | 1.00 | 1.00 | 70 | 4.47 |
| | R2—Fe—B | 14.9 | 0.00 | 14.9 | 0.00 | 0.00 | 75.7 | 5.41 | 2.00 | 1.00 | 1.00 | 30 | |
| | Composition after mixing | 14.9 | 10.4 | 4.47 | 0.00 | 0.00 | 75.7 | 5.41 | 2.00 | 1.00 | 1.00 | — | |
| Example 20 | R1—Fe—B | 14.9 | 14.9 | 0.00 | 0.00 | 0.00 | 75.7 | 5.41 | 2.00 | 1.00 | 1.00 | 50 | 7.45 |
| | R2—Fe—B | 14.9 | 0.00 | 14.9 | 0.00 | 0.00 | 75.7 | 5.41 | 2.00 | 1.00 | 1.00 | 50 | |
| | Composition after mixing | 14.9 | 7.45 | 7.45 | 0.00 | 0.00 | 75.7 | 5.41 | 2.00 | 1.00 | 1.00 | — | |
| Example 21 | R1—Fe—B | 14.9 | 14.9 | 0.00 | 0.00 | 0.00 | 75.7 | 5.41 | 2.00 | 1.00 | 1.00 | 30 | 10.4 |
| | R2—Fe—B | 14.9 | 0.00 | 14.9 | 0.00 | 0.00 | 75.7 | 5.41 | 2.00 | 1.00 | 1.00 | 70 | |
| | Composition after mixing | 14.9 | 4.47 | 10.4 | 0.00 | 0.00 | 75.7 | 5.41 | 2.00 | 1.00 | 1.00 | — | |
| Example 22 | R1—Fe—B | 14.9 | 14.9 | 0.00 | 0.00 | 0.00 | 75.7 | 5.41 | 2.00 | 1.00 | 1.00 | 20 | 11.9 |
| | R2—Fe—B | 14.9 | 0.00 | 14.9 | 0.00 | 0.00 | 75.7 | 5.41 | 2.00 | 1.00 | 1.00 | 80 | |
| | Composition after mixing | 14.9 | 2.98 | 11.9 | 0.00 | 0.00 | 75.7 | 5.41 | 2.00 | 1.00 | 1.00 | — | |

TABLE 10-continued

| | | TRE [at %] | Nd [at %] | Dy [at %] | Tb [at %] | Ho [at %] | Fe [at %] | B [at %] | Co [at %] | Cu [at %] | Al [at %] | Mixing ratio [wt %] | Concentration of R2 after mixing [at %] |
|---|---|---|---|---|---|---|---|---|---|---|---|---|---|
| Example 23 | R1—Fe—B | 14.9 | 14.9 | 0.00 | 0.00 | 0.00 | 75.7 | 5.41 | 2.00 | 1.00 | 1.00 | 10 | 13.4 |
| | R2—Fe—B | 14.9 | 0.00 | 14.9 | 0.00 | 0.00 | 75.7 | 5.41 | 2.00 | 1.00 | 1.00 | 90 | |
| | Composition after mixing | 14.9 | 1.49 | 13.4 | 0.00 | 0.00 | 75.7 | 5.41 | 2.00 | 1.00 | 1.00 | — | |

Then, for the obtained sintered compacts, the manufacture of the alloy sheets, pulverization, pressing, sintering and evaluation were similarly performed as in Example 1. The results were shown in Table 11.

TABLE 11

| | Number of M1 grains | Number of M2 grains | Concentration of R2 | Core part of M1 [at %] | | Shell part of M1 [at %] | | Core part of M2 [at %] | | Shell part of M2 [at %] | | Br | HcJ |
|---|---|---|---|---|---|---|---|---|---|---|---|---|---|
| | [%] | [%] | [at %] | αR1 | αR2 | βR1 | βR2 | γR1 | γR2 | εR1 | εR2 | [kG] | [kOe] |
| Comparative Example 30 | 23.4 | 1.7 | 0.30 | 11.8 | 1.7 | 1.7 | 11.8 | 1.9 | 11.5 | 11.4 | 1.1 | 13.6 | 14.2 |
| Comparative Example 31 | 10.9 | 3.6 | 0.75 | 11.8 | 1.8 | 2.0 | 11.1 | 1.1 | 11.6 | 11.3 | 1.6 | 13.5 | 18.2 |
| Example 18 | 7.2 | 8.1 | 1.19 | 11.7 | 1.3 | 1.2 | 11.5 | 1.1 | 11.6 | 11.4 | 1.5 | 13.5 | 25.2 |
| Example 19 | 6.9 | 9.5 | 4.47 | 11.9 | 1.7 | 1.9 | 11.6 | 1.5 | 11.3 | 11.6 | 1.8 | 13.4 | 25.7 |
| Example 20 | 6.1 | 12.8 | 7.45 | 11.4 | 1.4 | 1.6 | 11.2 | 1.1 | 11.7 | 11.5 | 1.1 | 13.3 | 26.8 |
| Example 21 | 5.0 | 15.2 | 11.0 | 11.3 | 1.3 | 1.0 | 11.5 | 2.0 | 11.9 | 11.3 | 1.3 | 13.1 | 27.3 |
| Example 22 | 4.5 | 18.2 | 11.9 | 12.0 | 1.3 | 1.4 | 11.5 | 1.4 | 11.0 | 11.7 | 1.3 | 11.2 | 27.5 |
| Example 23 | 3.2 | 25.6 | 13.4 | 11.3 | 1.9 | 2.4 | 11.9 | 1.5 | 11.7 | 11.7 | 1.6 | 10.2 | 27.6 |

In all of Comparative Examples 30 to 31 and Examples 18 to 23, the main phase grain M1 having a core-shell structure and the main phase grain M2 having a core-shell structure were both present, wherein the core part of the main phase grain M1 had a higher atom concentration of the light rare earth element(s) and the shell part had a higher atom concentration of the heavy rare earth element(s), and the core part of the main phase grain M2 had a higher atom concentration of the heavy rare earth element(s) and the shell part had a higher atom concentration of the light rare earth element(s). In addition, according to Examples 18 to 23. when the number ratio occupied by the M1 grains and the M2 grains were 5% or more and the content of R2 was 11 at % or less, the residual magnetic flux density was maintained to be high and a high coercivity was provided. In Comparative Examples 30 to 31 where the M2 grains accounted for 5% or less in number, the coercivity was low. It was considered that since a low amount of the heavy rare earth element(s) was added, the number of the core-shell grains was small. Thus, the improving effect on the coercivity was not sufficient. In another respect, in Examples 22 to 23 with more than 11 at % of R2 contained, a high coercivity was provided but the residual magnetic flux density decreased greatly. This might be due to the addition of the heavy rare earth element(s), leading to the decreased saturation magnetization.

Examples 24 to 25

In order to prepare the R1-T-B based alloy and the R1-R2-T-B based alloy, the metals and the alloy raw materials were mixed together to provide the raw materials having the compositions shown in Table 12. And they were melted and then casted by the strip casting method to provide alloy sheets respectively. Then, the pulverization, pressing and sintering were similarly performed as in Example 1.

TABLE 12

| | | TRE [at %] | Nd [at %] | Pr [at %] | La [at %] | Co [at %] | Y [at %] | Dy [at %] | Tb [at %] | Ho [at %] | Fe [at %] | B [at %] | Co [at %] | Cu [at %] | Al [at %] | Mixing ratio [wt %] | Concentration of R2 after mixing [at %] |
|---|---|---|---|---|---|---|---|---|---|---|---|---|---|---|---|---|---|
| Example 19 | R1—Fe—B | 14.9 | 14.9 | 0.00 | 0.00 | 0.00 | 0.00 | 0.00 | 0.00 | 0.00 | 75.7 | 5.41 | 2.00 | 1.00 | 1.00 | 60 | 2.98 |
| | R2—Fe—B | 14.9 | 7.45 | 0.00 | 0.00 | 0.00 | 0.00 | 7.45 | 0.00 | 0.00 | 75.7 | 5.41 | 2.00 | 1.00 | 1.00 | 40 | |
| | Composition after mixing | 14.9 | 11.9 | 0.00 | 0.00 | 0.00 | 0.00 | 2.98 | 0.00 | 0.00 | 75.7 | 5.41 | 2.00 | 1.00 | 1.00 | — | |
| Example 20 | R1—Fe—B | 14.9 | 14.9 | 0.00 | 0.00 | 0.00 | 0.00 | 0.00 | 0.00 | 0.00 | 75.7 | 5.41 | 2.00 | 1.00 | 1.00 | 70 | 3.13 |
| | R2—Fe—B | 14.9 | 4.47 | 0.00 | 0.00 | 0.00 | 0.00 | 10.4 | 0.00 | 0.00 | 75.7 | 5.41 | 2.00 | 1.00 | 1.00 | 30 | |
| | Composition after mixing | 14.9 | 11.8 | 0.00 | 0.00 | 0.00 | 0.00 | 3.13 | 0.00 | 0.00 | 75.7 | 5.41 | 2.00 | 1.00 | 1.00 | — | |

Thereafter, for the obtained sintered compacts, the manufacture of the alloy sheets, the pulverization, pressing, sintering and evaluation were similarly performed as in Example 1. The results were shown in Table 13.

TABLE 13

| | Number of M1 grains | Number of M2 grains | Core part of M1 [at %] | | Shell part of M1 [at %] | | Core part of M2 [at %] | | Shell part of M2 [at %] | | Br | HcJ |
|---|---|---|---|---|---|---|---|---|---|---|---|---|
| | [%] | [%] | αR1 | αR2 | βR1 | βR2 | γR1 | γR2 | εR1 | εR2 | [kG] | [kOe] |
| Comparative Example 1 | 0.0 | 0.0 | — | — | — | — | — | — | — | — | 14.2 | 12.2 |
| Example 1 | 7.2 | 8.8 | 11.7 | 1.3 | 1.2 | 11.5 | 1.1 | 11.6 | 11.4 | 1.5 | 13.5 | 25.2 |
| Example 24 | 7.1 | 8.3 | 8.1 | 3.6 | 3.5 | 9.1 | 3.8 | 8.3 | 9.2 | 3.2 | 13.4 | 24.0 |
| Example 25 | 7.0 | 8.1 | 7.2 | 4.9 | 4.3 | 8.2 | 4.8 | 7.4 | 8.1 | 3.9 | 13.5 | 23.7 |

In Examples 24 and 25, a core-shell structure was formed, wherein the core part had a higher amount of the heavy rare earth element(s) and the shell part had a higher amount of the light rare earth element(s). Compared to the Comparative Example 1, a higher coercivity was provided. When compared to Example 1, a higher coercivity was provided even if the ratio of R1 to R2 in the core part changed.

What is claimed is:

1. A rare earth based permanent magnet comprising a sintered compact with an R-T-B based composition, wherein, the sintered compact comprises two kinds of main phase grains M1 and M2, wherein, the concentration distribution of R in M1 is different from that in M2, R comprises R1 and R2, R1 represents at least one rare earth element including Y and excluding Dy, Tb and Ho, R2 represents at least one selected from the group consisting of Ho, Dy and Tb, the main phase grain M1 comprises a core-shell structure which contains a core part and a shell part coating the core part, when the atom concentrations of R1 and R2 in the core part are defined as αR1 and αR2 respectively, and the atom concentrations of R1 and R2 in the shell part are defined as βR1 and βR2 respectively, the following conditions are met, i.e., αR1>βR1, αR2<βR2, αR1>αR2 and βR1 <βR2, the main phase grain M2 has a core-shell structure which contains a core part and a shell part coating the core part, when the atom concentrations of R1 and R2 in the core part are defined as γR1 and γR2 respectively, and the atom concentrations of R1 and R2 in the shell part are defined as εR1 and εR2 respectively, the following conditions are met, i.e., γR1<εR1, γR2>εR2, γR1 <γR2 and εR1>εR2, a region containing the center of the main phase grain and having a concentration difference in the heavy rare earth element of 3% or more compared with an outer edge part of the main phase grain is defined as the core part, and a part other than the core part is defined as the shell part, the atom concentrations of R1 and R2 are obtained by calculating the average concentrations of 20 visual fields in element mapping by Electron Probe Micro analyzer (EPMA) of 256 points×256 points using an area of 50 μm×50 μm as a unit cross-section, and relative to all the main phase grains observed at a unit cross-section of the sintered compact, the ratios occupied by the main phase grains having the core-shell structure are 5% or more, respectively.

2. The rare earth based permanent magnet of claim 1, wherein, the sintered compact comprises 11 at % or less of R2.

* * * * *